US007201375B2

(12) United States Patent
Adam et al.

(10) Patent No.: US 7,201,375 B2
(45) Date of Patent: Apr. 10, 2007

(54) CASINO CARD GAMES WITH ONE OR MORE COMMUNITY CARDS

(75) Inventors: Donna J. Adam, Littleton, CO (US); James M. Wisler, Littleton, CO (US)

(73) Assignee: Masque Publishing, Inc., Englewood, CO (US)

( * ) Notice: Subject to any disclaimer, the term of this patent is extended or adjusted under 35 U.S.C. 154(b) by 136 days.

(21) Appl. No.: 10/817,011

(22) Filed: Apr. 1, 2004

(65) Prior Publication Data

US 2005/0218596 A1 Oct. 6, 2005

(51) Int. Cl.
*A63F 1/00* (2006.01)

(52) U.S. Cl. ..... 273/292; 273/274

(58) Field of Classification Search ..... 273/250–299, 273/300–349; 463/1–49
See application file for complete search history.

(56) References Cited

U.S. PATENT DOCUMENTS

| | | | | | |
|---|---|---|---|---|---|
| 4,861,041 | A | | 8/1989 | Jones et al. | 273/292 |
| 5,078,405 | A | | 1/1992 | Jones et al. | 273/309 |
| 5,288,081 | A | | 2/1994 | Breeding | 273/292 |
| 5,489,101 | A | * | 2/1996 | Moody | 273/292 |
| 5,544,892 | A | | 8/1996 | Breeding | 273/292 |
| 5,657,993 | A | | 8/1997 | Merlino et al. | 273/292 |
| 5,685,774 | A | * | 11/1997 | Webb | 463/13 |
| 5,794,934 | A | * | 8/1998 | Malcolm | 273/292 |
| 5,799,945 | A | | 9/1998 | Boylan et al. | 273/292 |
| 5,845,906 | A | | 12/1998 | Wirth | 273/274 |
| 5,901,958 | A | | 5/1999 | Andrews | 273/292 |
| 6,102,402 | A | | 8/2000 | Scott et al. | 273/292 |
| 6,461,240 | B1 | | 10/2002 | Perkins | 463/13 |
| 6,503,145 | B1 | | 1/2003 | Webb | 463/16 |
| 2001/0040345 | A1 | * | 11/2001 | Au-Yeung | 273/303 |
| 2002/0027322 | A1 | | 3/2002 | Breeding et al. | 273/292 |
| 2002/0077168 | A1 | | 6/2002 | Jones et al. | 463/13 |
| 2002/0125642 | A1 | | 9/2002 | Wells | 273/292 |
| 2002/0153662 | A1 | | 10/2002 | Webb et al. | 273/292 |
| 2002/0175468 | A1 | | 11/2002 | Kenny et al. | 273/274 |
| 2002/0195775 | A1 | | 12/2002 | Webb et al. | 273/292 |
| 2002/0195776 | A1 | | 12/2002 | Jones | 273/292 |
| 2003/0075869 | A1 | | 4/2003 | Breeding et al. | 273/292 |

* cited by examiner

*Primary Examiner*—Benjamin Layno
(74) *Attorney, Agent, or Firm*—Sheridan Ross P.C.

(57) ABSTRACT

A poker game that uses a five card hand in making certain determinations related to player payouts is provided. The game has one or more community cards that can be used by each player and, preferably also, by the dealer in deciding the best five card player and dealer hands. The player payouts can include a predetermined hand and higher payout and a bet payout. The predetermined hand and higher payout does not depend on whether the dealer hand is a qualified hand. The bet payout does depend on whether the dealer hand is a qualified hand. The community card by itself can also be used in determining a player payout.

25 Claims, 1 Drawing Sheet

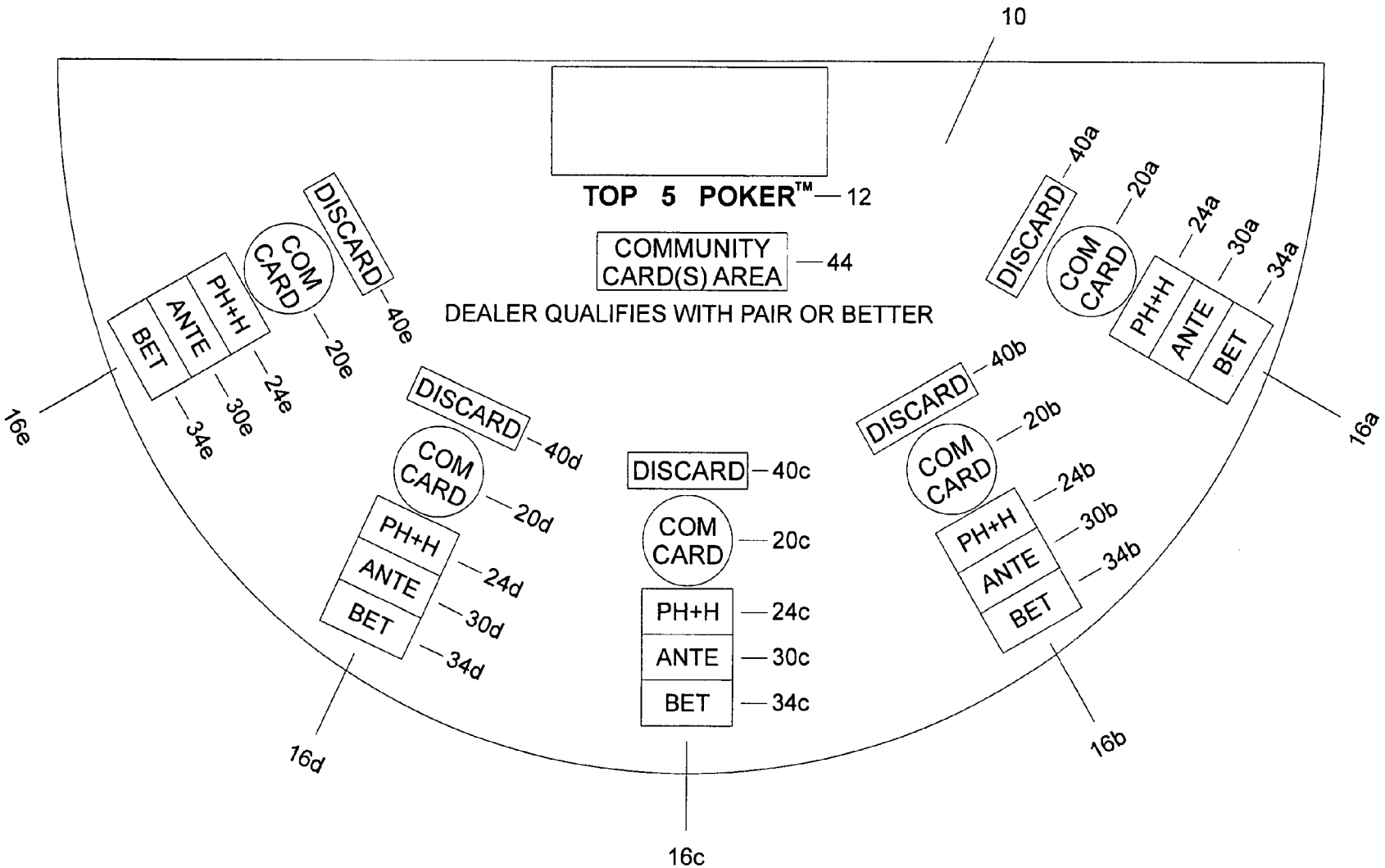
10
TOP 5 POKER™
12
COMMUNITY CARD(S) AREA
44
DEALER QUALIFIES WITH PAIR OR BETTER
DISCARD
40a
COM CARD
20a
PH+H
ANTE
BET
24a
30a
34a
16a
DISCARD
40b
COM CARD
20b
PH+H
ANTE
BET
24b
30b
34b
16b
DISCARD
40c
COM CARD
20c
PH+H
ANTE
BET
24c
30c
34c
16c
DISCARD
40d
COM CARD
20d
PH+H
ANTE
BET
24d
30d
34d
16d
DISCARD
40e
COM CARD
20e
PH+H
ANTE
BET
24e
30e
34e
16e

CASINO CARD GAMES WITH ONE OR MORE COMMUNITY CARDS

FIELD OF THE INVENTION

The present invention relates to casino card games and, in particular, to a poker game played with at least one community card.

BACKGROUND OF THE INVENTION

Casino card games, such as poker and blackjack, continue to be a major source of entertainment for card players. Poker games with features that are different from those found in conventional poker have increased in popularity over the recent years. Such poker games are available in many casinos located throughout the United States where legal gambling is offered. These include the poker games identified as CARIBBEAN STUD® Poker, LET IT RIDE®, THREE CARD POKER® and CRAZY 4® Poker.

Among the aspects valued by players of these poker games are speed of play and a number of betting options to choose from, which contribute to the excitement of playing the game. THREE CARD POKER® has these beneficial features and has proven to be highly attractive to a great number of poker players. However, the conventional five card hand is not used in making determinations related to winning or losing hand positions. Furthermore, no community card is used. Players therefore do not have the option of using one or more community cards, while discarding an equivalent card(s), in order to improve their hands. It would therefore be advantageous to integrate the relatively high speed play of games such as THREE CARD POKER® with other features such as the use of one or more community cards, while the hand relied on remains the traditional five card poker hand.

SUMMARY OF THE INVENTION

In accordance with the present invention, a casino card game is provided that uses one or more community cards, with each being available for possible selection and use by at least each player of the game and preferably for possible selection and use by the dealer as well. In a preferred embodiment, only one community card is available to be used, although in other embodiments, two or more community cards could be used.

The casino card game of the present invention includes a game layout having playing areas. The playing areas can include a separate playing area for each of a plurality of players. The playing areas can also include a dealer area for a dealer. The playing area of each player can have a number of wagering areas: a first or community card wagering area, a second or ante wagering area, a third or bet wagering area and a fourth or predetermined hand and higher waging area (PH+H, e.g., a pair of 10's or better). The playing area of each player can also include a discard area. Each player playing area has a section or area over which each player's cards are contained and this area can include at least parts of the bet wagering area. The dealer playing area can include a community card(s) area and dealer cards area.

The community card(s) dealt by the dealer is (are) placed in the community card(s) area(s) of the layout. One or more cards discarded by one or more of players are placed in the player's discard area. For each player: (a) any community card wager made is placed in his community card wagering area; (b) any ante wager made by the player is placed in his ante wagering area; (c) any bet wager made by the player is placed in his bet wagering area; and (d) any predetermined hand and higher wager made by the player is placed in the predetermined hand and higher wagering area.

With respect to methods of play, such as the embodiment in which there is one community card, each player playing the game makes one or more decisions directed to playing a round of play. Each player decides whether or not to make a community card wager, a predetermined hand and higher wager and an ante wager. A player at the start of play for a particular round decides to make one or more of these wagers by placing an amount, a chip, or other indicia in his wagering area associated with that particular wager. In the preferred embodiment, at the start of the round, each player can make a wager in one, two or all three of the community card, ante and PH+H wagering areas.

Once the wagers are made by players that are playing the particular round of the game, the dealer places a card from the deck, which is preferably a 52 card deck, face up in the community card area so that all players can see it. Once the community card is dealt and seen by all players, potential players that have not placed a wager in one or more of the community card wagering area, the PH+H wagering area and the ante wagering area are not allowed to play the particular round of the game. For those players that have made a PH+H wager and/or an ante wager, the dealer deals five cards to each of them. These cards are dealt face down. The dealer also deals five cards to himself that are face down.

After the players receive their five cards, they must make certain determinations. A player can elect to fold or, alternatively, can elect to continue to play. For each player that elects to play, he must decide either to play the five cards that were dealt to him or elect to use the community card as a substitute for one of the five cards in his hand for the purpose of improving his hand. Players that made ante wagers must also wager an additional amount in the bet wagering area to continue to play.

For each player that decided to fold and did not make a bet wager in the bet wagering area, the dealer collects his PH+H and ante wagers. The dealer also collects any community card wagers when the community card is not a predetermined card or one of a group of predetermined cards. The dealer then turns over his five cards. The dealer uses the five cards dealt to him and the community card to decide his best five card hand. The dealer then announces whether or not he has a qualified hand. If the dealer's hand is a qualified hand, he will announce the value of his hand. After making known whether or not the dealer's hand is a qualified hand, a number of determinations are made by him related to any payment(s) to one or more players.

The dealer pays these players that made community card wagers when the community card is a predetermined card or one of a group of predetermined cards. In the preferred embodiment, when the community card is an ace or face (king, queen, jack) card, the dealer pays all players that made the community card wager according to a community card payout schedule. When the community card is the predetermined card or one of the predetermined cards, the player who made such a wager receives the payout, even if the player folds, regardless of whether the dealer's hand is a qualified hand or the dealer's hand beats the player's hand.

If the player has made a PH+H wager and the player's hand contains certain cards or better, the dealer pays that player according to a PH+H payout schedule. In a preferred embodiment, the predetermined hand and higher includes a pair of 10's or better. The dealer makes this payout to the player regardless of whether or not the dealer's hand qualifies or the dealer's hand beats the player's hand.

Additionally, when the dealer's hand is a qualified hand and the player's hand beats the qualified dealer's hand, the dealer pays the player one-to-one on the ante wager and the dealer pays the bet wager according to a bet payout schedule. On the other hand, if the dealer's qualified hand beats the player's hand, the dealer collects both the ante and bet wagers from the player. If the dealer's hand is not a qualified hand, each player that has not folded is paid one-to-one on the ante wager and the bet wager pushes. In one embodiment, a qualified hand is one that contains at least a pair or better. Once all determinations are made related to payouts and the determined payouts are made according to the proper payout schedule(s), all cards played in that round are placed in a discard rack. A new round of the game can then be started.

Based on the foregoing summary, a number of salient features of the present invention are readily discerned. A casino card game is provided that offers the player a number of wagering options. There are numerous payouts based on the different wagering options and there can be different payout schedules for each of them. One or more community cards are used to provide the player with the capability of improving his hand. The community card itself presents a potential payout for the player. Furthermore, the card game of the present invention can be played rapidly, while using a traditional five card poker hand. The card game is also easy to play and benefits both the player and the casino.

Additional advantages of the present invention will become readily apparent from the following discussion, particularly when taken together with accompanying drawing.

BRIEF DESCRIPTION OF THE DRAWING FIGURE

The sole FIGURE illustrates a table layout for a five card poker game using one community card.

DETAILED DESCRIPTION

With reference to the FIGURE, a layout 10 of a casino poker game of a preferred embodiment is illustrated. The layout 10 identifies components, areas or sections of a table or a cover overlying a table that can be used in playing the poker game.

The layout 10 can be defined as having a dealer playing area 12 and a plurality of player playing areas 16, such as five playing areas 16*a*–16*e* illustrated in the FIGURE, although more than five playing areas 16 are possible.

Each player playing area 16*a*–16*e* is the same. A description of one player playing area 16*a* applies to all other playing areas 16*b*–16*e*. The player playing area 16*a* includes a number of wagering areas. The wagering areas can include: a community card ("comcard") wagering area 20*a*, a predetermined and higher (PH+H) wagering area 24*a*, an ante wagering area 30*a* and a bet wagering area 34*a*. The cards that are dealt to the player playing the poker game at playing area 16*a* can be placed adjacent to the bet wagering area 34*a*. In the preferred embodiment, when the player using the playing area 16*a* makes a bet wager, at least part of the bet is placed over portions of one or more of the cards which are face down and which make up at least part of the player's hand. The player playing area 16*a*, like all player playing areas 16, has a discard area 40*a*. Each discard area 40 is typically located closer to the dealer than to the particular player. The discard area 40 can be used in receiving at least one card that is discarded by the player when the player decides to play the particular round of the poker game and relies on at least one community card as part of the player's hand, as will be explained in more detail in connection with descriptions related to playing the poker game. In another embodiment, instead of the player deciding whether or not to use the community card, the dealer determines the player's best five card poker hand. In such an embodiment, the player does not discard to his discard area 40 but relies on the dealer to decide what five cards will be used in determining the player's betting hand.

With respect to the wagering areas 16, each player can make one or more wagers to play, or continue to play, the current round of the poker game. The community card wagering area 20*a* is used by the player associated with the playing area 16*a* to make a community card or comcard wager. In making any such wager, the player places a chip or other indicia indicative of the amount being wagered in the comcard wagering area 20*a*. The player is entitled to a payout when the community card dealt by the dealer for that round is a predetermined card or one of a group of predetermined cards. In one embodiment, the player's wager in the comcard wagering area 20*a* is successful when the community card dealt by the dealer is one of an ace or a face card. More specifically, the payout made to the player making such a comcard wager can be based on a single community card payout schedule using the predetermined contents of a table, as will be subsequently described.

In the preferred embodiment, such a payout is made to each player making such a comcard wager regardless of whether the player makes any other wager, or later folds, and regardless of whether the dealer hand is a qualified hand or the dealer hand beats the particular player's hand. In one embodiment, the dealer has a qualified hand when the dealer is dealt a pair or better, although other qualified dealer hands are possible. With respect to such determinations, the community card is typically the first card dealt and is provided face up by the dealer in the community card(s) area 44 of the dealer playing area 12.

As is the case with other player playing areas 16*b*–16*e*, the player associated with the player playing area 16*a* has the ability to make a PH+H wager by placing a betting chip in the PH+H wagering area 24*a*. When that wager is made, that player is successful when the player's hand has a predetermined rank or better. In a preferred embodiment, the player's hand is a winning hand when it includes a pair of 10's or better. When this occurs and the player has made the PH+H wager, he is paid according to a PH+H payout schedule using the predetermined formulas found in the relevant table to be discussed later herein. This payout is made regardless of whether the dealer hand is a qualified hand or the dealer's hand beats the player's hand.

The player associated with the playing area 16*a* can make an ante wager using the ante wagering area 30*a*. In one embodiment, in order to play the next round of the poker game, the player must make an ante wager, including make an ante wager if the player wants to make a comcard wager.

Regarding the bet wagering areas 34, such as the bet wagering area 34*a*, these are used by one or more players in order to make a bet wager. The bet wager is made by the player who has made an ante wager and does not fold after his cards are dealt, but continues to play the current round of the game. The bet wager, in one embodiment, is exactly the same as the player's ante wager. When the player's hand beats the dealer's hand, when the dealer's hand is a qualified hand, the bet wager has a payout schedule that is based on the predetermined information in another table that will be presented later as part of additional descriptions related to this particular payout.

Methodologies related to playing the casino poker game of the present invention, particularly one in which there is only one community card, are now provided. Preferably, the game is played using only one standard deck of 52 cards. After the cards are shuffled, the dealer first checks to make sure that all players that want to play the next round have all their wagers placed. Players make a community card wager, a PH+H wager and/or an ante wager in their respective wagering areas, which indicates that they are playing the next round.

The dealer then places the first card from the newly shuffled deck face up in front of the dealer's position so that all players can see this first card, which is the community card. All players, including the dealer, may optionally use the community card to form a desired, or anticipated better five-card hand. Once the community card is revealed, in the preferred embodiment, players that have not placed a wager in one or more of the identified wagering areas are not allowed to play the round.

The dealer continues by dealing five cards to each player position that has a wager in one or both of the PH+H wagering area and the ante wagering area. Each set of five cards to each player is dealt face down, preferably to the player's bet wagering area, with one arm motion by the dealer in order to facilitate dealing from a shuffling machine. The dealer then deals five cards face down to himself.

After the players receive their five cards, they look at them to decide how to proceed. The players have two basic options, namely, either fold or play. If a player elects to fold, he places all five cards dealt to him face down in the player's discard area 40. On the other hand, if a player elects to play, he has two choices to select from, namely: each player electing to play either plays the five cards dealt to him or elects to use the community card in place of one of the five cards in his hand for the anticipated purpose of improving his hand. If the player decides to play the five cards that were dealt to him, he places them all face down with at least one corner of the cards in the bet wagering area. If the player made an ante wager, he must wager an additional amount, which is exactly the same as his ante wager, by placing this amount in the bet wagering area. Preferably, the player is also required to ensure that at least one corner of his dealt cards is under the amount (e.g. chip) located in his bet wagering area. When the player makes this election, he uses only the five cards dealt to him in determining his five card poker hand for this particular round.

Alternatively, if the player elects to play using the community card, he must discard one of the five cards that were dealt to him by placing it face down on the layout 10 in the discard area 40. If the player made an ante wager, he must wager an additional amount, which is exactly the same as his ante wager, by placing this amount in the bet wagering area. Preferably, the player also ensures that at least one corner of his remaining four-card, face down hand is in the bet wagering area and under the amount (e.g. chip) if a bet wager was placed in the bet wagering area. This player uses his four remaining cards (does not include the card that was discarded) and the community card to arrive at his five card hand for the round. Next, the dealer collects all PH+H and ante wagers from players that have folded. If a community card is not a predetermined card(s), such as an ace or face card (ace, king, queen or jack), the dealer also collects all community card wagers. The dealer then collects all discards, from his right to his left, including any individual cards that were discarded by players that wish to use the community card as part of their five-card hand, and places them in the discard rack.

The dealer then turns over his five cards. From the six cards available to him that include the five cards dealt to the dealer and the community card, the dealer determines his best five card hand. If the dealer's determined hand uses the community card, the dealer will place the least favorable of the five cards dealt to him in the discard rack. As part of the analysis made regarding the dealer's hand, a determination is made as to whether or not it is a "qualified" hand. In one embodiment, the dealer's hand is a qualified hand if it has a "pair or better." The dealer then indicates whether his hand is a qualified hand. If it is a qualified hand, the dealer states the value of his hand. After such indications are provided, the dealer settles all player hands from his right to his left. In so doing, the dealer will pick up each player's hand and place it face up, preferably on the dealer's side of the layout 10 and adjacent to each player's respective wagering area.

Referring to settlement of community card wagers, in the case of a payout to one or more players that made the community card wager and the requirement that the community card be an ace or face card, the dealer pays all such wagers according to the following "Ace or Face Card Payout Table." This payout is made irrespective of whether the player folds, the dealer's hand is a qualified hand, or the dealer's hand beats the player's hand.

Ace or Face Card Payout Table

| Community Card | Payout |
|---|---|
| Ace | 4 to 1 |
| King | 2 to 1 |
| Queen | 3 to 2 |
| Jack | 6 to 5 |

Another player settlement to be made concerns the PH+H wager, such as a pair of 10's or better. If the player folds, any such wager made by the player is lost. Conversely, if a player has made a PH+H (e.g. pair of 10's or better) wager and his hand contains at least this predetermined hand or better, the dealer pays the player according to a predetermined schedule, which, in this embodiment, requires the PH+H be a pair of 10's or better. The player having such a predetermined hand is paid regardless of whether the dealer's hand is a qualified hand or the dealer's hand beats the player's hand. Only the highest payout achieved is paid using the contents of the table set out below.

10's or Better Payout Table

| Player Hand | Payout |
|---|---|
| Royal Flush | 250 to 1 |
| Straight Flush | 75 to 1 |
| Four of a Kind | 25 to 1 |
| Full House | 15 to 1 |
| Flush | 5 to 1 |
| Straight | 3 to 1 |
| Two Pair or Three of a Kind | 1 to 1 |
| Pair 10's or Better | 1 to 1 |

Additionally, the dealer must settle ante and bet wagers. In one embodiment, the dealer has a qualified hand if such a hand contains at least a pair or better. The ante and bet wagers are settled according to the following Ante/Bet Payout Table, and with only the highest payout achieved being paid.

Ante/Bet Payout Table

| Situation | Result | |
|---|---|---|
| Player folds | The Ante wager is lost | |
| Player does not fold and Dealer's hand does not qualify | Dealer pays 1 to 1 on the Ante wager, the Bet wager pushes | |
| Dealer's hand qualifies and beats the player's hand | Dealer collects player's Ante and Bet wagers | |
| Dealer's hand qualifies and the player's hand beats the dealer's hand | Dealer pays 1 to 1 on the Ante wager, the Bet wager is paid according to the following: | |
| | Royal Flush | 100 to 1 |
| | Straight Flush | 25 to 1 |
| | Four of a Kind | 12 to 1 |
| | Full House | 5 to 1 |
| | Flush | 4 to 1 |
| | Straight | 3 to 1 |
| | Winning Hand | 1 to 1 |

In one or more other embodiments, instead of a single community card, playing of the game might involve two community cards. Play is similar to a single community card play. In these multiple community card embodiments, the players do not discard any cards if they are not folding their hands. From each of the originally dealt five card hands and the community cards, the dealer only must determine which cards make the best five card hand for each player and for the dealer himself. There is a different community card payout when there are two community cards, instead of one community card. In this embodiment, the following payouts are available.

Ace(s) or Face Card(s) Payout Table
(2 Community Cards)

| Community Cards | Payout |
|---|---|
| Pair Aces | 50 to 1 |
| Pair Kings | 40 to 1 |
| Pair Queens | 30 to 1 |
| Pair Jacks | 20 to 1 |
| Ace + Face | 5 to 1 |
| 2 Face | 2 to 1 |

Another embodiment has three community cards that the players and the dealer can optionally use in determining their hands. Like the embodiments in which there are one community card and two community cards, there is a different payout schedule when three community cards are utilized. In this embodiment, the following table identifies the particular payout, depending on the community cards that are dealt for the particular round.

Ace(s) or Face Card(s) Payout Table
(3 Community Cards)

| Community Cards | Payout |
|---|---|
| 3 Aces | 50 to 1 |
| 3 Kings | 40 to 1 |
| 3 Queens | 30 to 1 |
| 3 Jacks | 20 to 1 |

-continued

Ace(s) or Face Card(s) Payout Table
(3 Community Cards)

| Community Cards | Payout |
|---|---|
| Pair Aces | 10 to 1 |
| Pair Kings | |
| Pair Queens | |
| Pair Jacks | |
| Ace + 2 Face | 5 to 1 |
| KQJ | 3 to 1 |
| 2 Ace or Face | 1 to 1 |

The predetermined hand and higher and the ante/bet payouts also change when there are two community cards or three community cards. The following two tables illustrate such payouts for two or three community cards and where the predetermined hand and higher is a "pair of 10's or better."

10's or Better Payout Table
(2 or 3 Community Cards)

| | 2 cards | 3 cards |
|---|---|---|
| 10's or Better Pair | Lose | Lose |
| Two Pairs | 1 to 1 | Lose |
| 3 of a Kind | 1 to 1 | 1 to 1 |
| Straight | 2 to 1 | 2 to 1 |
| Flush | 3 to 1 | 3 to 1 |
| Full House | 4 to 1 | 4 to 1 |
| Four of a Kind | 8 to 1 | 6 to 1 |
| Straight Flush | 15 to 1 | 10 to 1 |
| Royal Flush | 25 to 1 | 25 to 1 |

Ante/Bet Payout Table
(2 or 3 Community Cards)

| | 2 cards | 3 cards |
|---|---|---|
| Pair | Not Qual | Not Qual |
| Pair of Sixes | 1 to 1 | Not Qual |
| Pair of Queens | 1 to 1 | 1 to 1 |
| Two Pairs | 1 to 1 | 1 to 1 |
| 3 of a Kind | 1 to 1 | 1 to 1 |
| Straight | 1 to 1 | 1 to 1 |
| Flush | 2 to 1 | 1 to 1 |
| Full House | 3 to 1 | 2 to 1 |
| Four of a kind | 4 to 1 | 7 to 1 |
| Straight Flush | 8 to 1 | 10 to 1 |
| Royal Flush | 20 to 1 | 25 to 1 |

In another embodiment, the player has the option to make another wager related to which player for the round has the best hand ("top player wager"). Basically, the top player wager is successful when the player's hand beats all other player hands, all of which players made the top player wager. Consequently, in addition to playing against a dealer, each player has an option to make a wager that he will beat all other players that make the top player wager. Like other amounts that can be wagered, a wagering area for each player can be provided for the top player wager. In one embodiment, the amount that can be wagered for the top player wager is the same as the minimum ante wager allowable at the particular table. When settling the particular hand, for each player that has made a top player wager, a determination is made as to which player has the superior or best hand. The player with the superior hand is paid based on, or a function of, the top player wager or wagers made by one or more of the other players. For example, the player having the superior hand might be paid the amount of the top player wager made by each of the other players that he beat. In the case of ties between/among players, these players would equally share in any payout. Alternatively, the dealer may be entitled to some percentage of the amount based on the top player wagers made. In one embodiment, the dealer also makes a top player wager and receives all top player wagers when the dealer's hand beats all players' hands, who made a top player wager. In another embodiment, the dealer only makes a top player wager whenever there is only one player making the top player wager. When the dealer participates in the play associated with the top player wager, the dealer need not actually place a bet in a wagering area. If the dealer's hand beats the players' hands, who made the top player wager, the dealer collects the top player wagers made by those other players. If the dealer's hand is not the best hand, the dealer pays the player who had the best hand one-to-one on the top player wager.

The foregoing discussion of the inventions has been presented for purposes of illustration and description. Further, the description is not intended to limit the inventions to the form disclosed herein. Consequently, variations and modifications commensurate with the above teachings, within the skill or knowledge of the relevant art, are within the scope of the such inventions. By way of example only, player payment settlements could be made in a different order than that described in the preferred embodiment. The embodiments described hereinabove are further intended to explain the best modes presently known of practicing the inventions and to enable others skilled in the art to utilize the inventions in such, or in other embodiments, and with various modifications required by their particular application or use. It is intended that the appended claims be construed to include alternative embodiments to the extent permitted by the prior art.

What is claimed is:

1. A method for playing a card game, comprising:

providing at least two wagering areas including an ante wagering area for making an ante wager and a bet wagering area for making a bet wager;

making said ante wager by at least a first player of a number of players;

dealing by a dealer one community card that is face up, said one community card being the only community card dealt during the playing of the card game;

before any bet wager is made, subsequently to said ante wager dealing by the dealer five cards that are face down to the first player and five cards that are face down to the dealer, wherein each player of the number of players that makes said ante wager is dealt five cards;

deciding for the first time by the first player, at least after said one community card is dealt face up and after said five cards are dealt face down, whether or not to continue to play and, if so, determining by the first player whether or not to discard one of said five cards that are dealt face down to the first player and, if so, using said one community card as a replacement card for said one card that is discarded and also making a bet wager by the first player in said bet wagering area, wherein said bet wager is made by the first player after said five cards and said one community card are dealt;

deciding by the dealer, at least after said one community card is dealt face up, whether or not to use said one community card as a replacement card for one of said five cards; and making determinations related to at least the dealer and the first player including whether the dealer hand, if qualified, beats at least the first player hand.

2. The method of claim 1 wherein said deciding by the first player includes locating said one of said five cards in a discard area.

3. The method of claim 1 wherein said card game is poker.

4. The method of claim 1 further includes ascertaining whether or not the dealer hand is a qualified hand and, if not, paying the first player a first predetermined amount based on said ante wager when the first player makes said bet wager.

5. The method of claim 4 wherein said bet wager pushes when the dealer hand is not a qualified hand.

6. The method of claim 1 further including providing a community card wagering area for making a community card wager.

7. The method of claim 6 wherein said making determinations includes paying the first player a second predetermined amount when the first player makes said community card wager and said one community card is a predetermined card.

8. The method of claim 7 wherein said predetermined card is from the group consisting of: an ace, a king, a queen and a jack.

9. The method of claim 7 wherein the first player is paid said second predetermined amount even if the first player does not make a bet wager.

10. The method of claim 7 wherein the first player is paid said second predetermined amount even if the dealer's hand is not a qualified hand.

11. The method of claim 7 wherein the first player is paid the second predetermined amount even if the dealer hand beats the first player hand.

12. The method of claim 1 further including providing a 10's or better wagering area for making a 10's or better wage and when the first player makes a 10's or better wager and said first player hand includes 10's or better, paying the first player a third predetermined amount that depends on said first player hand.

13. The method of claim 1 in which the first player locates said bet wager over at least a portion of at least a first card of said five cards.

14. The method of claim 1 wherein said making determinations includes collecting by the dealer at least said ante wager made by the first player when the first player folds and does not make said bet wager.

15. The method of claim 1 wherein said making determinations includes collecting by the dealer said one card that is discarded by the first player when the first player uses said one community card.

16. The method of claim 1 wherein said making determinations includes changing by the dealer said five cards of the first player from face down to face up and the dealer hand is selected by the dealer from said five cards dealt to the dealer and said one community card.

17. The method of claim 1 wherein said making determinations include the dealer announcing whether the dealer hand is a qualified hand and changing at least some of said plurality of cards from face down to face up.

18. The method of claim 1, wherein said providing includes providing ante/bet wager payouts and in which the first player is paid a predetermined amount when the first player makes said bet wager and said one community card is a predetermined card and also the first player is paid said predetermined amount when the first player does not inake said bet wager and said one community card is said predetennined card.

19. The method of claim 1, wherein said providing includes providing ante/bet wager payouts and in which said ante/bet wager payouts are determined using at least said one community card and no other community card.

20. The method of claim 1, wherein said dealing by the dealer of said one community card is conducted before said dealing by the dealer of said five cards.

21. A method for playing a card game, comprising:

providing at least two wagering areas including an ante wagering area for making an ante wager and a bet wagering area for making a bet wager;

making said ante wager by at least a first player of a number of players;

dealing by the dealer first and second community cards that are face up, said first and second community cards are the only community cards dealt during the playing of the card game;

before any bet wager is made, subsequently to said ante wager dealing by the dealer five cards that are face down to at least the first player and five cards that are face down to the dealer, wherein each player of the number of players that makes said ante wager is dealt five cards;

deciding for the first time by the first player, at least after said first and second community cards are dealt face up and after said five cards are dealt face up, whether or not to continue to play and, if so, making a bet wager by the first player in said bet wagering area, wherein said bet wager is made by the first player after said five cards and said first and second community cards are dealt; and making determinations related to at least the dealer and the first player including whether the dealer hand, if qualified, beats at least the first player hand.

22. The method of claim 21, wherein said making determinations includes deciding by the dealer the best five card hand of the first player using said first and second community cards and said five cards dealt to the first player.

23. The method of claim 21, wherein said providing includes providing ante/bet wager payouts and in which the first player is paid a predetermined amount when the first player makes said bet wager and said one community card is a predetermined card and also the first player is paid said predetermined amount when the first player does not make said bet wager and said one community card is said predetermined card.

24. The method of claim 21, wherein said providing includes providing ante/bet wager payouts and in which said ante/bet wager payouts are detennined using at least said one community card and no other community card.

25. The niethod of claim 21, wherein said dealing by the dealer of said one community card is conducted before said dealing by the dealer of said five cards.

* * * * *